US006965192B2

(12) United States Patent
Sukeno et al.

(10) Patent No.: US 6,965,192 B2
(45) Date of Patent: Nov. 15, 2005

(54) COLOR PICTURE TUBE APPARATUS

(75) Inventors: Masahiko Sukeno, Takatsuki (JP); Yasuyuki Ueda, Hirakata (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 157 days.

(21) Appl. No.: 10/389,125

(22) Filed: Mar. 14, 2003

(65) Prior Publication Data

US 2003/0178930 A1 Sep. 25, 2003

(30) Foreign Application Priority Data

Mar. 20, 2002 (JP) ..... 2002-077853

(51) Int. Cl.[7] ..... H01J 29/58; H01J 29/70
(52) U.S. Cl. ..... 313/414; 313/409; 313/441
(58) Field of Search ..... 313/409, 412, 313/414, 416, 441, 458

(56) References Cited

U.S. PATENT DOCUMENTS

| | | | | |
|---|---|---|---|---|
| 4,581,560 A | | 4/1986 | Shirai et al. | |
| 5,572,085 A | * | 11/1996 | Choi | 313/414 |
| 5,610,481 A | | 3/1997 | Shirai et al. | |
| 5,675,211 A | | 10/1997 | Ueda | |
| 5,726,539 A | | 3/1998 | Spanjer et al. | |
| 6,239,546 B1 | * | 5/2001 | Wada et al. | 313/456 |
| 2001/0030500 A1 | | 10/2001 | Diamon et al. | |

FOREIGN PATENT DOCUMENTS

| | | | | |
|---|---|---|---|---|
| EP | 0 901 146 | | 3/1999 | |
| EP | 1 146 540 | | 10/2001 | |
| JP | 63245846 A | * | 10/1988 | H01J 29/50 |
| JP | 2-18540 | | 1/1990 | |
| JP | 02065037 A | * | 3/1990 | H01J 29/50 |
| JP | 06187921 A | | 8/1994 | |
| JP | 8-22780 | | 1/1996 | |
| JP | 3040272 | | 3/2000 | |
| JP | 2000067774 A | * | 3/2000 | H01J 29/50 |
| JP | 2001-357796 | | 12/2001 | |

* cited by examiner

*Primary Examiner*—Mariceli Santiago

(57) ABSTRACT

A color picture tube apparatus having an inline electron gun that allows technology for applying a dynamic voltage to an OLF lens to be implemented, while avoiding design difficulties. Eave-shaped electrode plates are attached, parallel with each other in a horizontal scan direction, to a field-correction electrode plate, which is a horizontally long, flatten plate in which three holes are provided, and whose shape is similar to that of an aperture in a circumferential electrode. This structure allows quadrupole lenses to be formed as auxiliary lenses having strong focusing action horizontally and divergent action vertically, and thus an HV differential can be increased. As a result, it is possible to reduce the dynamic voltage without any of the design difficulties accompanying the prior art, in which eave-shaped electrode plates are not provided.

3 Claims, 13 Drawing Sheets

COLOR PICTURE TUBE APPARATUS

BACKGROUND OF THE INVENTION

1. Field of the Invention

The present invention relates to color picture tube apparatuses, and in particular to electrodes that constitute main lenses for focusing a plurality of electron beams on a screen.

2. Related Art

Generally, a color picture tube apparatus has an envelope formed from a panel and a funnel joined to the panel, and displays color images by emitting three electron beams from an electron gun disposed in a neck of the funnel, onto a phosphor screen formed opposite a shadow mask on an inner surface of the panel, while scanning horizontally and vertically, the three electron beams being deflected by horizontal and vertical magnetic deflection fields generated by a deflection yoke mounted to the outside of the funnel.

The magnetic fields of the deflection yoke used in the above color picture tube apparatus generally have a self-convergence structure to focus the three electron beams on the screen, and as a result the horizontal and vertical magnetic deflection fields are distorted into a pin-cushion shape and a barrel shape, respectively. The three electron beams that pass through the magnetic deflection fields thus undergo divergent action horizontally and focusing action vertically.

When the electron beam trajectory is lengthened due to an increase in the deflection angle, astigmatism becomes pronounced because of these magnetic self-convergence fields, particularly in a vicinity of the phosphor screen surface, and horizontal resolution is reduced as a result of the electron beam spots becoming a flattened, oblong-shape along a major axis in the horizontal direction when viewed in cross-section. This problem has been accentuated in recent years as panels become flatter and deflection angles increase.

Thus, in order to describe a high-resolution image on a phosphor screen, it is first necessary to horizontally reduce the spot diameter using the electron gun.

A known technique that attempts to do this involves applying a dynamic voltage to a focusing electrode structuring the electron gun. According to this technique, a voltage that increases with increases in the deflection angle is applied to a focusing electrode positioned closest to and facing a final electrode, and as a result, the action by the main lens electric field weakens as the deflection angle increases, astigmatism is corrected, and the shape of the beam spot is controlled.

In an application of this dynamic voltage technique disclosed in Japanese patent no. 3,040,272, attempts are made to minimize the applied dynamic voltage by adjusting the shape and orientation of beam through holes in the electrodes, and regulating the conditions under which a voltage is applied to the electrodes.

As an aside, generally the fewer spherical aberrations there are in the main lens electric field of the electron gun, the greater are the achievable reductions in the spot diameter in a color picture tube apparatus. Given an angle of incidence of the electron beams to the main lens electric field of $\alpha$, the most improved spherical aberration of the main lens electric field can contribute a spot diameter $\delta$ of:

$$\delta=(M\cdot CsP\cdot\alpha^3)/2$$

Here, M is a lens magnification, and CsP is a spherical aberration coefficient. As can be inferred from this equation, weakening the lens action by the main lens electric field allows for reductions in spherical aberration. In other words, by effectively increasing the lens diameter resulting from the main lens electric field, it is possible to reduce the spot diameter on the phosphor screen.

The OLF (over-lapping field) lens disclosed in Japanese examined patent application publication 2-18540 is an example of technology that realizes this idea by way of the electrode configuration. This configuration is shown in FIG. 13.

As shown in FIG. 13, the main electrodes are constituted by a focusing electrode 101 and a final accelerating electrode 102 provided with a gap therebetween in a tube axis direction, and a shield cap 103 connected to final accelerating electrode 102.

Focusing electrode 101 and final accelerating electrode 102 are formed respectively from (i) tubular circumferential electrodes 101A and 102A, each of which has a horizontally wide, flattened tube-shape, and encompasses the three electron beams, and (ii) field-correction electrode plates 101B and 102B, each of which is set back from the facing edges of the tubular circumferential electrodes, and has three holes 101B1, 101B2, 101B3 and 102B1, 102B2, 102B3, respectively, opened therein to allow the electron beams to pass through vertically. These field-correction electrode plates 101B and 102B generate three main lens electric fields corresponding to the three electron beams.

By setting field-correction electrode plates 101B and 102B back from the facing edges of tubular circumferential electrodes 101A and 102A in focusing electrode 101 and final accelerating electrode 102, respectively, the high potential of final accelerating electrode 102 is allowed to incur deep into focusing electrode 101, and the low potential of focusing electrode 101 is allowed to incur deep into final accelerating electrode 102. As a result, the lens diameter resulting from the main lens electric fields is effectively enlarged, and the spot diameter on the phosphor screen can be reduced.

When applying dynamic voltage technology to an electrode configuration structuring an OLF lens, and seeking furthermore to minimize the dynamic voltage, it is difficult to optimally design the beam through holes to satisfy all of the various requirements using a method that involves the adjustment of the shape/orientation of the beam through holes and the regulation of the voltage applied to the electrodes. Realizability is thus poor given these design restrictions.

SUMMARY OF THE INVENTION

An object of the present invention is to provide a color picture tube apparatus having an electron gun that allows for a dynamic voltage to be easily reduced when dynamic voltage technology is combined with an OLF lens.

A color picture tube apparatus provided to achieve this object includes: a panel that includes a screen having phosphors of a plurality of colors disposed thereon; an electron gun having a plurality of cathodes disposed inline, and a plurality of tubular electrodes arranged, with a gap therebetween, in a path of a plurality of electron beams emitted toward the screen from the cathodes, each tubular electrode (i) having an aperture common to the electron beams, and a field-correction electrode plate that has a plurality of beam through holes and is provided so as to be set back from an edge of the aperture with a main surface facing the gap, and (ii) generating a main lens electric field in the gap; and a pair of eave-shaped electrode plates provided on the field-correction electrode plate of at least one of the tubular electrodes, so as to be on either side of the beam through holes in a vertical scan direction, and to extend horizontally and toward the gap.

According to this structure, an auxiliary lens is formed by adding eave-shaped electrode plates to a conventional lens structure using a method that avoids design difficulties by providing a field-correction electrode plate and mounting the eave-shaped electrode plates thereon. The auxiliary lens is used to enlarge a difference between the horizontal and vertical focusing action of the main lens, and as a result it is possible to significantly reduce the dynamic voltage.

Here, the at least one tubular electrode having eave-shaped electrode plates provided on the field-correction electrode plate may include a final electrode positioned on a screen-side.

According to this structure, an auxiliary lens is formed nearest the screen-side in the electron gun, by providing a field-correction electrode plate and eave-shaped electrode plates in a final electrode, and thus the horizontal and vertical focusing action of the main lens can be efficiently adjusted.

Here, the at least one tubular electrode having eave-shaped electrode plates provided on the field-correction electrode plate may further include a focusing electrode positioned near to the final electrode.

This structure allows for spherical aberration to be reduced, and the effectiveness of double quadrupole lenses to be improved.

Here, a base of a shield cap provided on the screen-side of the final electrode may protrude into the final electrode and may function as the field-correction electrode plate.

This structure facilitates the assembly of the electron gun, because the field-correction electrode plate can be disposed within the final electrode when the shield cap is fitted to the final electrode.

BRIEF DESCRIPTION OF THE DRAWINGS

These and other objects, advantages and features of the invention will become apparent from the following description thereof taken in conjunction with the accompanying drawings that illustrate specific embodiments of the present invention.

In the drawings.

DETAILED DESCRIPTION OF THE PREFERRED EMBODIMENTS

Embodiment 1

A color picture tube 1 according to the embodiments of the present invention will now be described in detail with reference to the drawings.

Figure 1:
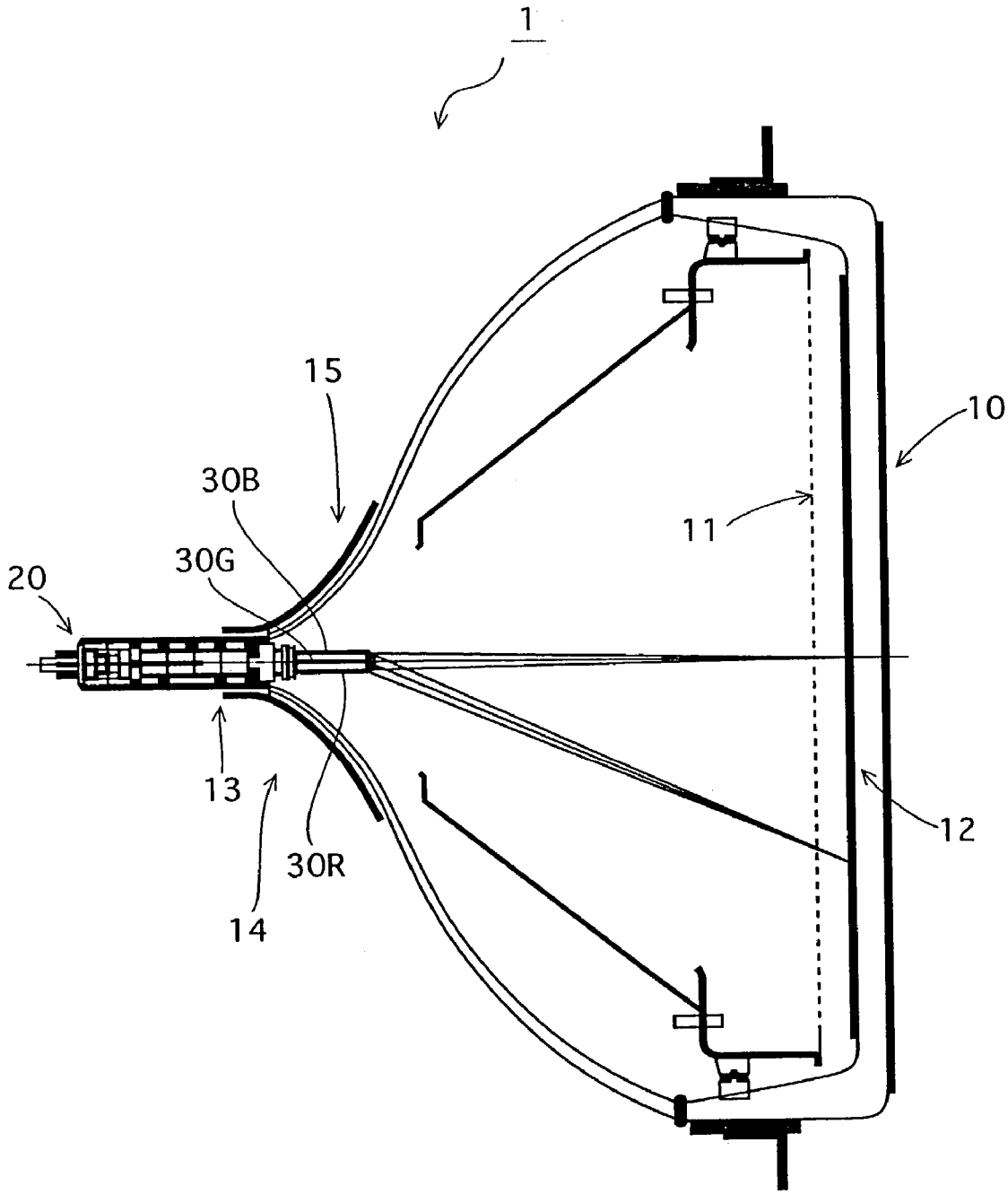
FIG. 1 is a cross-sectional view in a horizontal scan direction showing a structure of a color picture tube common to the embodiments.

FIG. 1 is a cross-sectional view in a horizontal scan direction showing a structure of color picture tube 1.

As shown in this diagram, color picture tube 1 is structured from a picture tube 10 and an inline electron gun 20. Picture tube 10 includes a screen 10 that has R (red), G (green) and B (blue) phosphors applied in layers on a backside thereof, so as to face a shadow mask 11 that has a large number of electron beam through holes formed therein. Inline electron gun 20 is inserted from the base of a neck 13 of picture tube 10. Three electron beams 30R, 30G and 30B, corresponding to the colors RGB and emitted from inline electron gun 20, pass through a magnetic deflection field induced by a deflection coil 15 provided along the surface of an interface between neck 13 and a widening part 14 of a funnel. Electron beams 30R, 30G and 30B are then each deflected by a predetermined amount both horizontally and vertically, and focused in a predetermined position on screen 12.

Inline electron gun 20 will now be described in detail.

Figure 2:
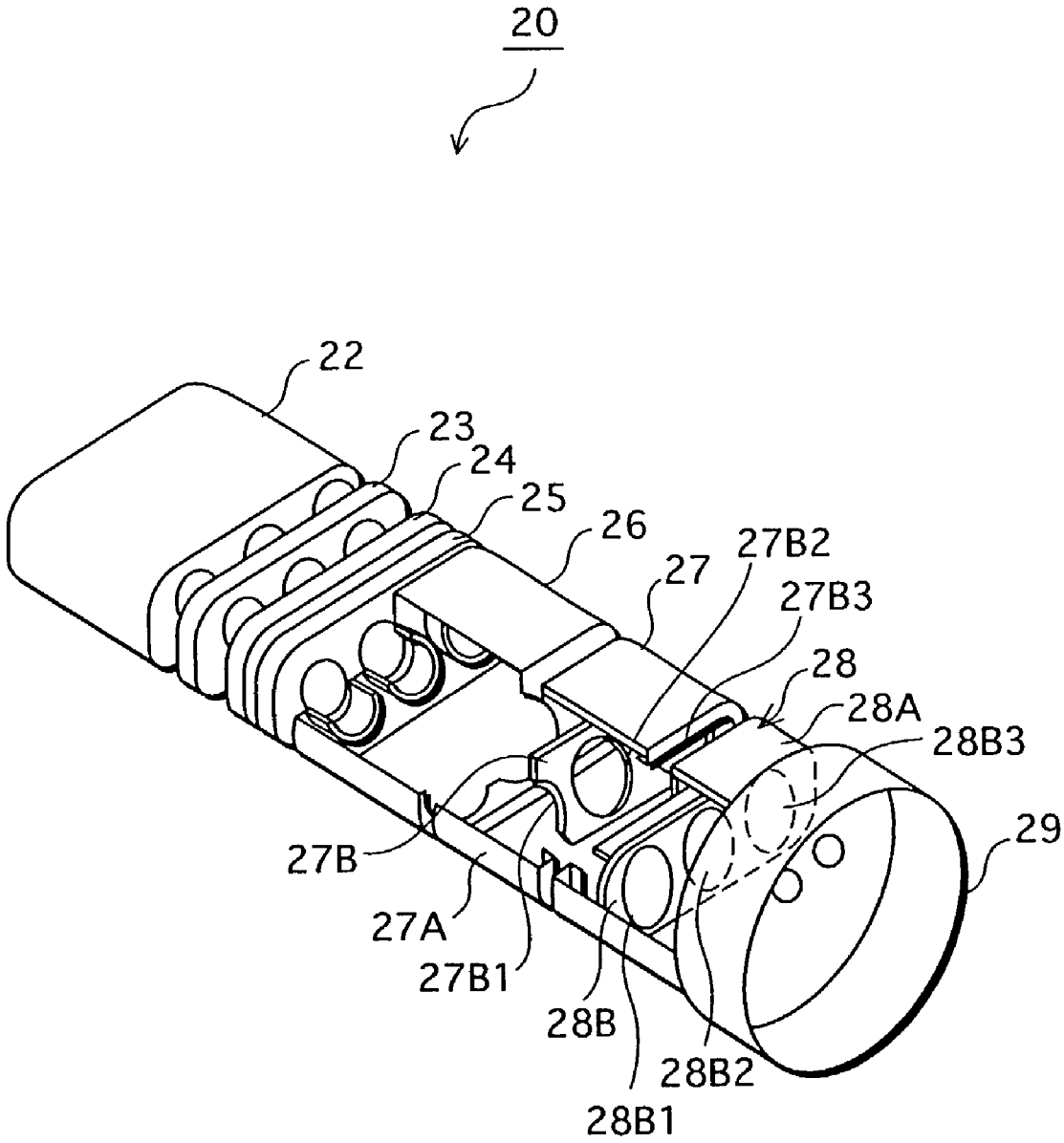
FIG. 2 is a perspective view showing a structure of an inline electron gun according to an embodiment 1.
Figure 3:
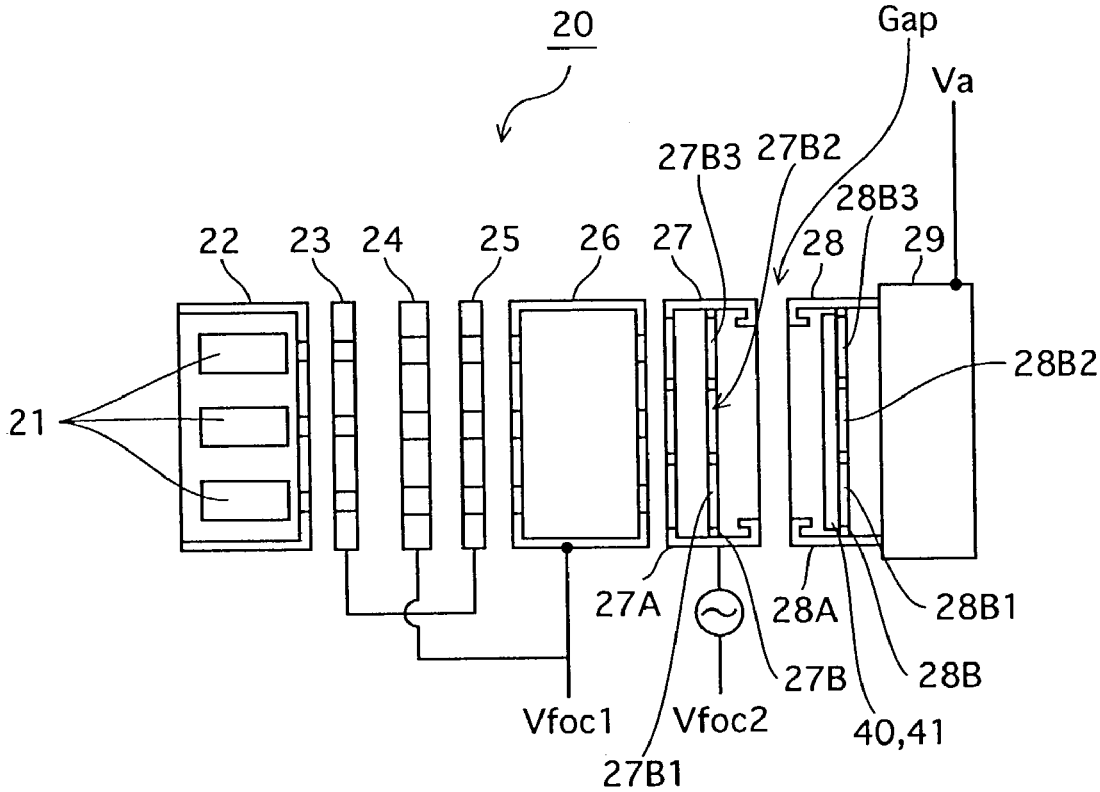
FIG. 3 is a plan view showing the structure of the inline electron gun in FIG. 2.

FIG. 2 is a perspective view of inline electron gun 20, and FIG. 3 is a plan view showing a detailed internal structure of inline electron gun 20.

As shown in these diagrams, inline electron gun 20 is formed from cathodes 21 disposed inline in a group of three, a grid electrode 22 that houses cathodes 21, an accelerating electrode 23, a focusing electrode 24, a focusing electrode 25, a focusing electrode 26, a focusing electrode 27, a final accelerating electrode 28, and a shield cap 29. Voltages forming electric fields for generating, accelerating and focusing the electron beams are applied to the electrodes in predetermined amounts, so as to generate a predetermined potential difference between the electrodes. The three electron beams are then emitted in a predetermined direction while controlling their diameter size and trajectory.

More specifically, the electron beams are generated by cathodes 21, and the energy levels (amount of current) of the electron beams are controlled by grid electrode 22 and accelerating electrode 23. A pre-focusing lens electric field is then generated between accelerating electrode 23 and focusing electrode 24, and the angle of divergence at which the electron beams are incident to the main lens electric field is adjusted. Focusing electrodes 24, 25 and 26 are unipotential, and function to support the preliminary focusing of the electron beams by the pre-focusing lens electric field.

As described above, focusing electrode 27 and final accelerating electrode 28 constitute the main lens electric field, and the electron beams, once final adjustments have been made to their angle of divergence by the main lens electric fields, are emitted towards a magnetic deflection field generated by a deflection coil.

Focusing electrode 27 and final accelerating electrode 28 are formed respectively from (i) tubular circumferential electrodes 27A and 28A which each have a horizontally long, flat tube-shape, and encompass the three electron beams, and (ii) field-correction electrode plates 27B and 28B, each of which are set back from the facing edges of tubular circumferential electrodes 27A and 28A, and have three holes 27B1, 27B2, 27B3 and 28B1, 28B2, 28B3, respectively, opened therein to allow the electron beams to pass through vertically. Focusing electrode 27 and final accelerating electrode 28 function to generate the main lens electric fields of the electron gun.

By setting field-correction electrode plates 27B and 28B back from the facing edges of tubular circumferential electrodes 27A and 28A in focusing electrode 27 and final accelerating electrode 28, the high potential (Va in FIG. 3) of final accelerating electrode 28 is allowed to incur deep into focusing electrode 27, and the low potential (Vfoc2 in FIG. 3) of focusing electrode 27 is allowed to incur deep into final accelerating electrode 28. Moreover, the inclusion of this field-correction electrode plate, particularly in relation to the final accelerating electrode, allows the three holes to be disposed close to the edge of circumferential electrode 28A facing the focusing electrode, in comparison to when a field-correction electrode plate is not provided. Thus, of the three lenses produced by the three electron beam through holes, the pitch between the center lens and the side lenses is greater than when a field-correction electrode plate is not provided (conversely, when a field-correction electrode plate is not provided, the three electron beam through holes are formed from only a member constituted by the shield cap, and the pitch narrows as the diameter of the three lenses widens nearer the lens center in the circumferential electrode, because of the through holes being positioned at a distance from the edge of circumferential electrode 28A facing the focusing electrode). This structure allows for the distance between the shadow mask and the screen to be reduced as the pitch between the center lens and the side lenses widens, and as a result beam aberration/displacement due to geomagnetism does not readily occur.

According to the above structure, a potential Vfoc1 is applied to focusing electrodes 24 and 26, and dynamic potential Vfoc2 is applied to focusing electrodes 27. Vfoc1 is constant, and Vfoc2 increases in response to the deflection amount of the electron beams. The relationship between the two is set such that at a deflection amount of zero (i.e. no deflection), Vfoc1>Vfoc2. Thus, by weakening the action by the main lens electric fields as the deflection amount increases, it is possible to correct for astigmatism and control the shape of the beam spots. Moreover, by controlling the dynamic voltage from an initial state of Vfoc1>Vfoc2, it is possible to allow for reductions in the dynamic voltage. This method is disclosed in detail in Japanese patent no. 3,040,272.

Figure 4:
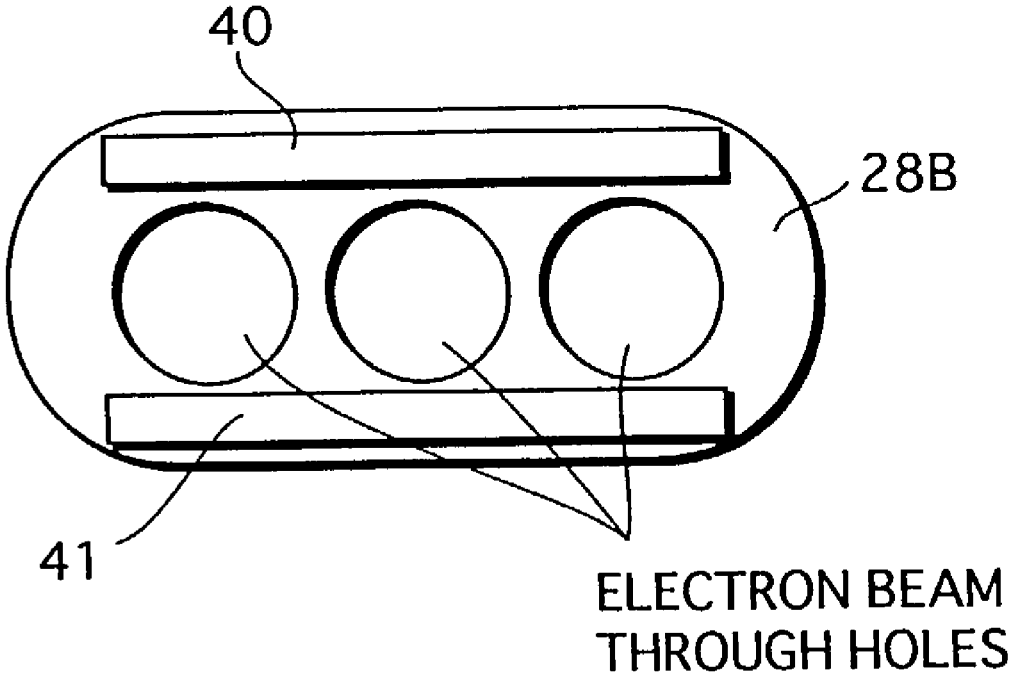
FIG. 4 is a frontal view showing a structure of a field-correction electrode plate and eave-shaped electrode plates.

A structural diagram of field-correction electrode plate 28B is shown in FIG. 4. As shown in this diagram, three circular holes are provided in field-correction electrode plate 28B, which is similar in shape to the aperture in circumferential electrode 28A, and has a horizontally long, flattened-shape.

Electrodes 40 and 41 (referred to as "eave-shaped electrode plates") are eave-shaped and attached conductively to this field-correction electrode plate. As shown in FIG. 4, eave-shaped electrode plates 40 and 41 are disposed horizontally parallel to each other, and so as to be on either side of the electron holes in the vertical scan direction. Moreover, as shown in FIGS. 2 and 3, electrode plates 40 and 41 are provided facing into the gap between focusing electrode 27 and final accelerating electrode 28, and protrude toward the gap.

By disposing the eave-shaped electrode plates to protrude toward the gap, it is possible to enlarge the horizontal and vertical focusing action differential (referred to as the "HV differential") of the main lenses, and to reduce the dynamic voltage as a result. Here, application of the dynamic voltage allows for increases in the HV differential and for a weakening in the lens action. It is also possible to directly ameliorate, with great sensitivity, any distortion of the spots or the electric fields constituting the main lenses.

Figure 6A:
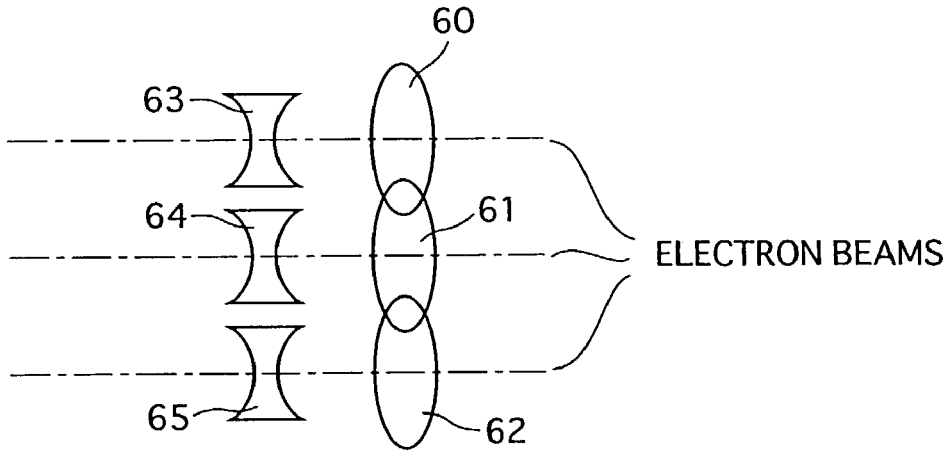
FIGS. 6A & 6B are model diagrams showing a main lens structure in an inline electron gun according to the prior art (eave-shaped electrode plates not provided)
Figure 6B:
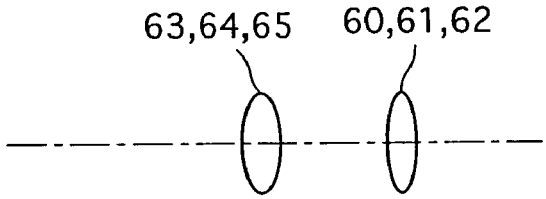

Here, FIGS. 6A and 6B show a lens model resulting from main lens electric fields when eave-shaped electrode plates 40 and 41 are not provided. FIG. 6A shows a horizontal cross-section (horizontal scan direction) and FIG. 6B shows a vertical cross-section (vertical scan direction) of the lens model.

As shown in these diagrams, the main lenses have different focusing action horizontally and vertically, and as mentioned above, setting the focusing action differential (i.e. HV differential) to a large value is important in reducing the dynamic voltage.

In this lens model, 60, 61 and 62 are main lenses resulting from the main lens electric fields, and constitute convex lenses having strong focusing action horizontally, and convex lenses having weaker focusing action vertically (weakness/strength of lens action is illustrated by lens thickness). To focus the electron beams on the screen, lenses 63, 64 and 65 are formed separately on a cathode-side of the main lenses (i.e. where the speed of the electron beams is relatively slow), so as to compensate for differences in the lens action generated horizontally and vertically. These lenses are quadrupole lenses that constitute concave lenses having strong divergent action horizontally, and convex lenses having strong focusing action vertically.

Figure 5A:
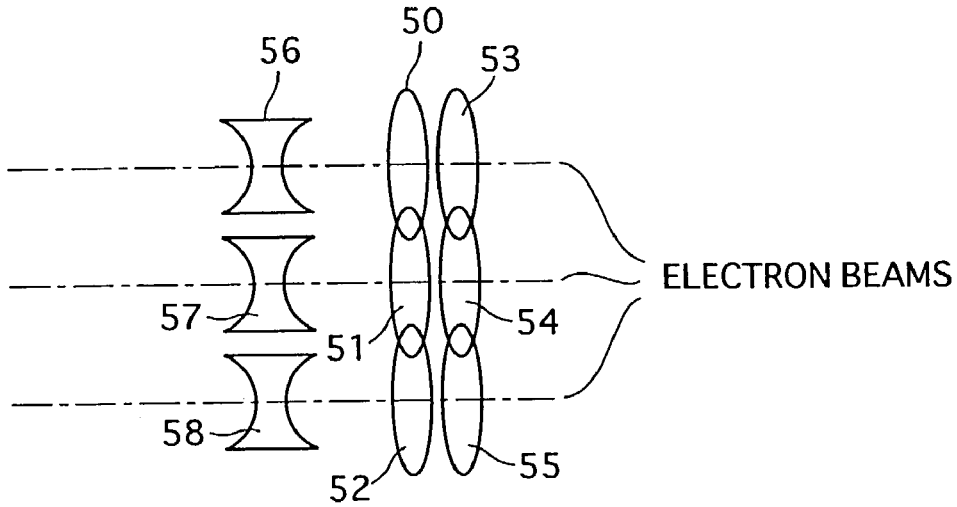
FIGS. 5A & 5B are model diagrams of a main lens structure in the inline electron gun of embodiment 1.
Figure 5B:
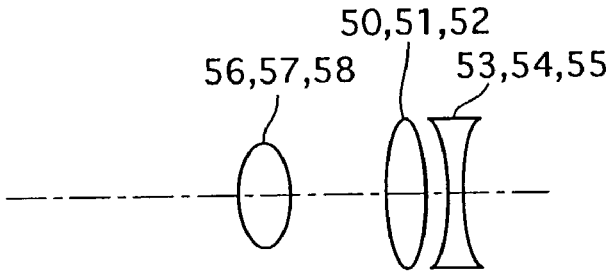

FIGS. 5A and 5B show a lens model resulting from main lens electric fields when eave-shaped electrode plates 40 and 41 are provided according to the present embodiment. FIG. 5A shows a horizontal cross-section (horizontal scan direction) and FIG. 5B shows a vertical cross-section (vertical scan direction) of the lens model.

As shown in these diagrams, auxiliary lenses resulting from the eave-shaped electrode plates have been added, and these auxiliary lenses are considered to function as main lenses.

More specifically, in this lens model, 50, 51 and 52 form one set of main lenses resulting from the main lens electric fields, and constitute convex lenses having strong focusing action horizontally, and convex lenses having focusing action vertically. Furthermore, in addition to lenses 50, 51 and 52, auxiliary lenses 53, 54 and 55 are formed by the inclusion of the eave-shaped electrode plates. These lenses are quadrupole lenses that constitute convex lenses having strong focusing action horizontally, and concave lenses having divergent action vertically. Then, to focus the electron beams on the screen, quadrupole lenses 56, 57 and 58 constituting concave lenses having strong divergent action horizontally, and convex lenses having strong focusing action vertically, are formed separately on the cathode-side of the main lenses to compensate for differences in the lens action generated horizontally and vertically.

As is clear from the above, the HV differential can be increased when auxiliary lenses are added by providing the eave-shaped electrode plates of the present embodiment. As a result, it is possible to reduce the dynamic voltage in comparison with the prior art (eave-shaped electrode plates not provided).

Figure 7:
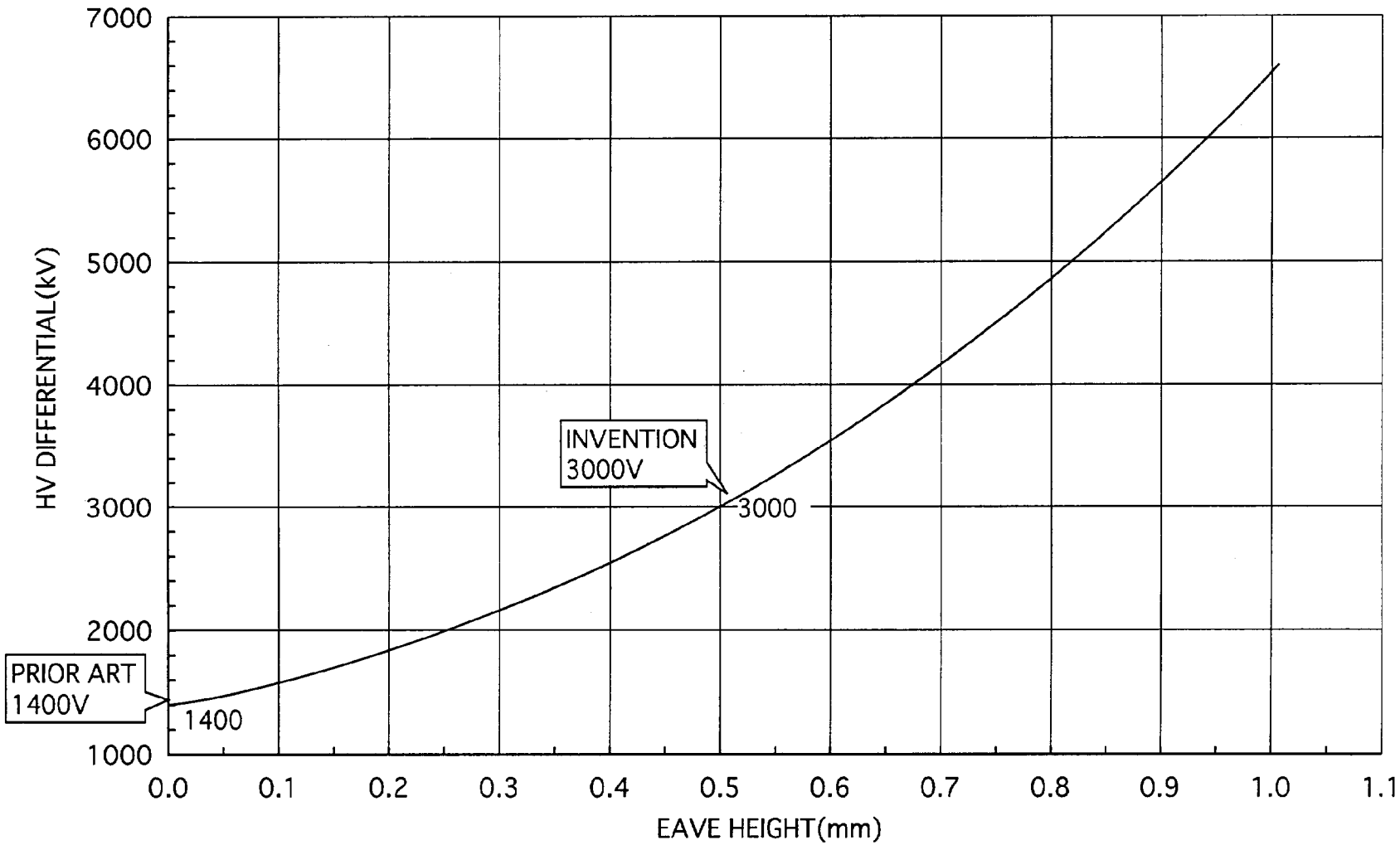
FIG. 7 shows changes in an HV differential (i.e. difference between horizontal and vertical focusing voltages) relative to changes in the height of the eave-shaped electrode plates from the field-correction electrode plate.

Here, a concrete example is given that relates to increasing the HV differential by providing eave-shaped electrode plates on the field-correction electrode plates. FIG. 7 shows changes in the HV differential relative to changes in a height of the eave-shaped electrode plates from the field-correction electrode plate. The HV differential when the height of the eave-shaped electrode plates is 0.0 (i.e. as in the prior art, when field-correction electrode plates are provided, but not eave-shaped electrode plates) is 4000V. In comparison, when eave-shaped electrode plates are attached, the HV differential increases with increases in the height of the eave-shaped electrode plates.

Figure 8:
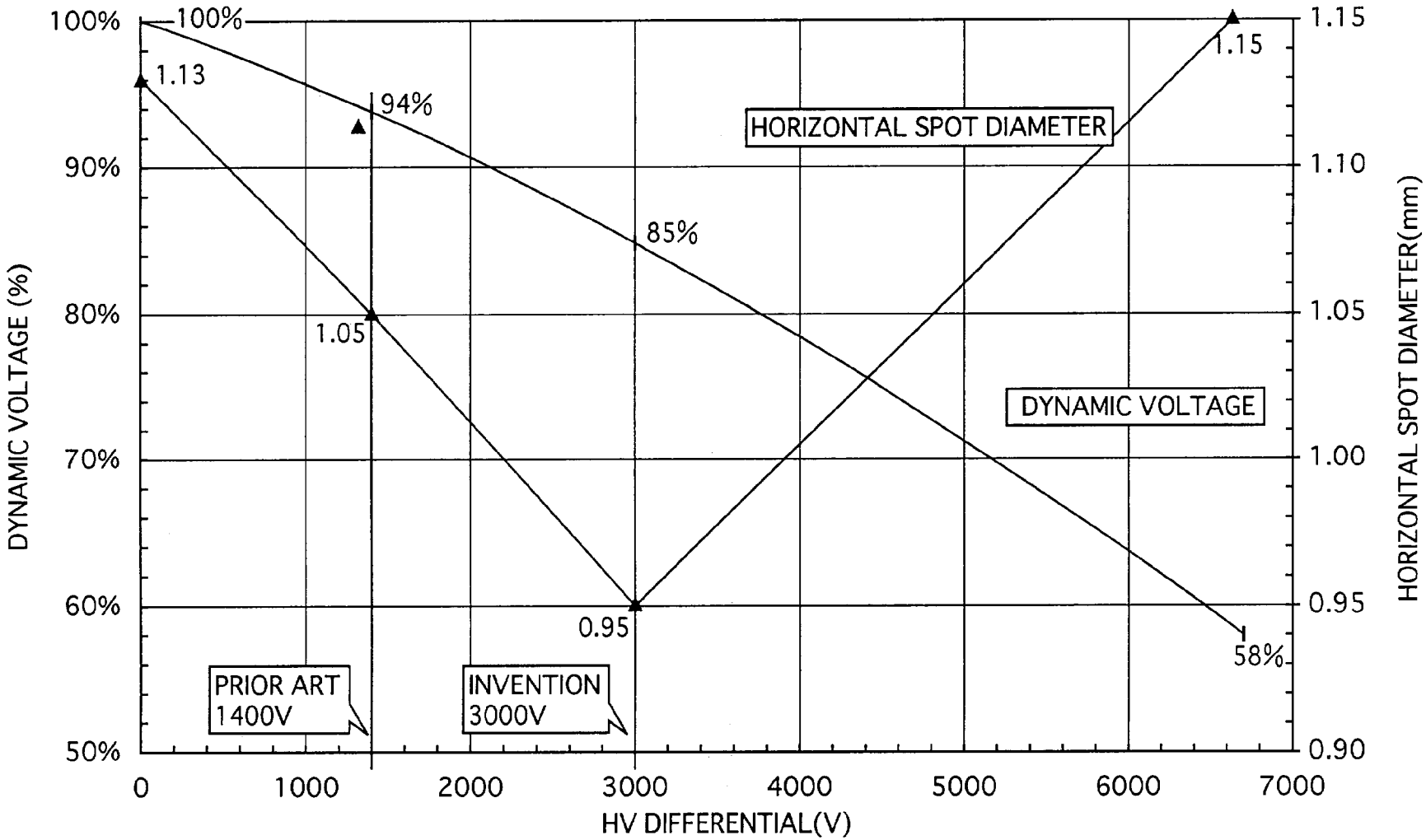
FIG. 8 shows changes in dynamic voltage and horizontal spot diameter when the HV differential is changed.

FIG. 8 shows changes in dynamic voltage and horizontal spot diameter when the HV differential is changed. Since dynamic voltage, and thus compressive strength, can be lowered by increasing the HV differential, simplification of the circuitry and cost saving are anticipated. However, changing the HV differential also changes the horizontal spot diameter, and because the horizontal spot diameter increases again after reaching a minimum value when the HV differential is raised, the HV differential is preferably set in the vicinity of where the horizontal spot diameter reaches the minimum value. In relation to the electron gun described in the present embodiment, the horizontal spot diameter is smallest when the HV differential is in the vicinity of 3000V.

Consequently, in the present embodiment, the height of the eave-shaped electrode plates is set to approximately 0.5 mm to achieve an HV differential of 3000V (see FIG. 7). In this way, both the dynamic voltage and the horizontal spot diameter can be set to a smaller value than the prior art. The measurements of other parts are included here for reference purposes: each tubular electrode having a field-correction electrode plate on which are provided eave-shaped electrode plates has a length of 7.0 mm in the tube-axis direction, the length from a screen-side edge of each tubular electrode to the field-correction electrode plate is 4.6 mm in the tube-axis direction, and each field-correction electrode plate has a thickness of 0.7 mm.

Here, the lens action is maximized by providing eave-shaped electrode plates 40 and 41 facing into and protruding toward the gap between focusing electrode 27 and final accelerating electrode 28. In other words, sensitivity with respect to the lens electric fields is raised by providing the tips of the eave-shaped electrode plates in a position close to the gap having a steep potential gradient. If the tips are positioned too close to the gap, however, unfavorable effects may occur, such as the generation of a discharge in a nearby area as a result of the thin plates being in proximity to the low-voltage side, and for this reason the tips need to be positioned so that a discharge is not generated. Here, the higher the eave-shaped electrode plates, the closer the tips are to the gap, and consequently, the greater are the reductions in dynamic voltage. By providing eave-shaped electrode plates on field-correction electrode plates that are disposed within a tubular part, as in the present invention, however, it is possible to bring the tips closer to the gap without necessarily increasing the height of the eave-shaped electrode plates themselves. The eave-shaped electrode plates can thus be attached with high precision, and as a result, this structure further allows for dispersion of action, caused by dispersion in the opening between the tips, to be avoided.

Furthermore, by being able to reduce the lens magnification horizontally and increase the lens magnification vertically as a result of the double quadrupole effect of quadrupole lenses 53, 54 and 55 on the screen-side and quadrupole lenses 56, 57 and 58 on the cathode-side, it is possible to further correct astigmatism and further suppress distortion of the electron beam spots in a sideways direction.

Figure 9:
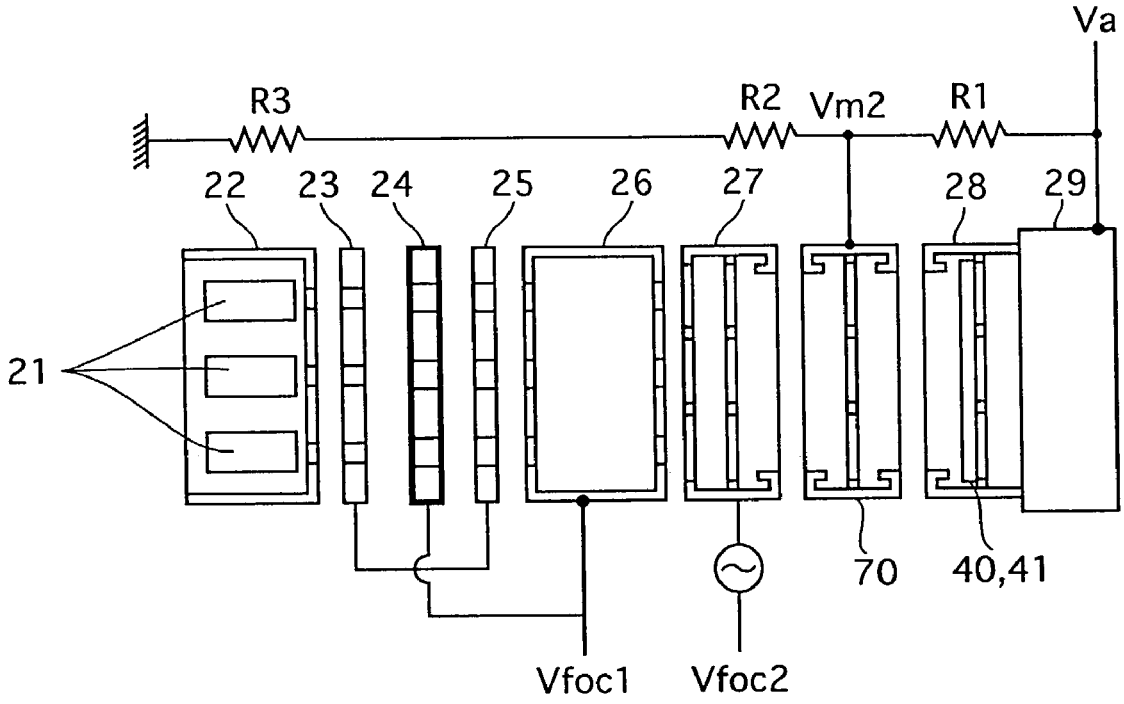
FIG. 9 is a plan view showing a structure of a variation of the inline electron gun of embodiment 1.

Here, the electron gun may also be structured as follows. FIG. 9 is a plan view showing a structure of this variation of the inline electron gun.

As shown in this diagram, in the variation, the inline electron gun includes an intermediate electrode 70 between focusing electrode 27 and final accelerating electrode 28. Here, a voltage Vm2 is applied to intermediate electrode 70 via a resistor R1. In addition to the above actions/effects, it is possible, according to this structure, to further enlarge the lens diameter effectively because of the expansion of the electric field lens in the tube axis direction. Related structures, effects and the like are detailed in Japanese examined patent application publication 8-22780.

Embodiment 2

An embodiment 2 of the present invention will now be described.

Figure 10:
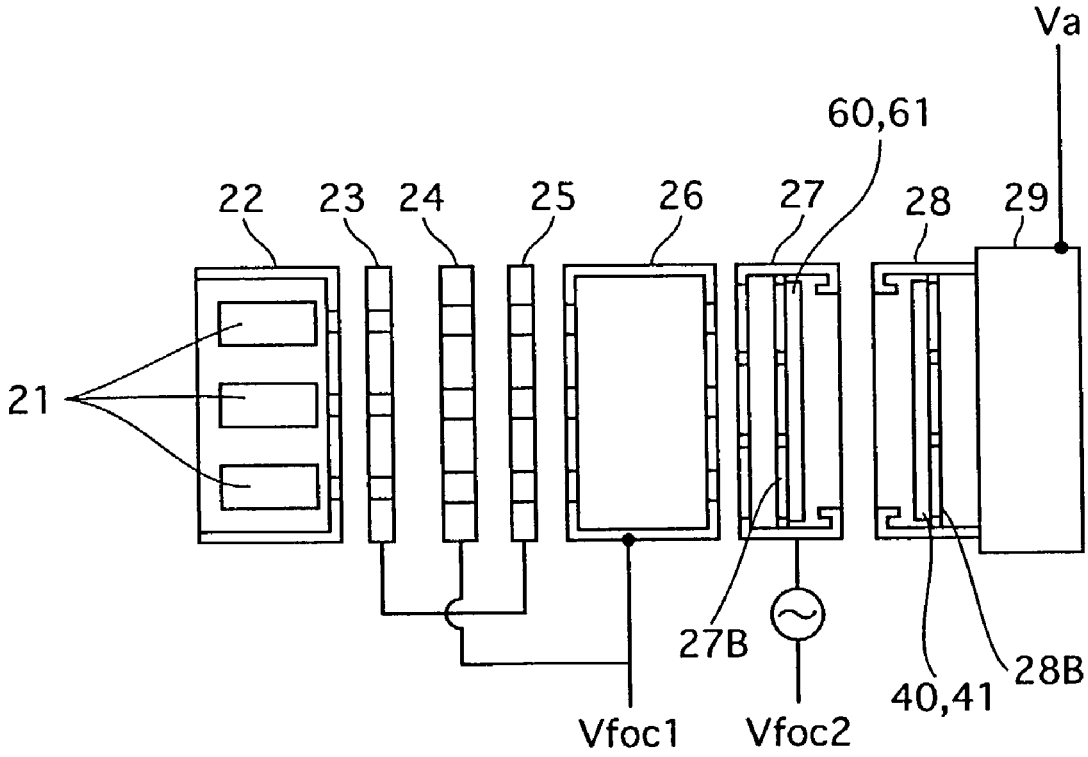
FIG. 10 is a plan view showing a structure of an inline electron gun according to an embodiment 2.
Figure 11A:
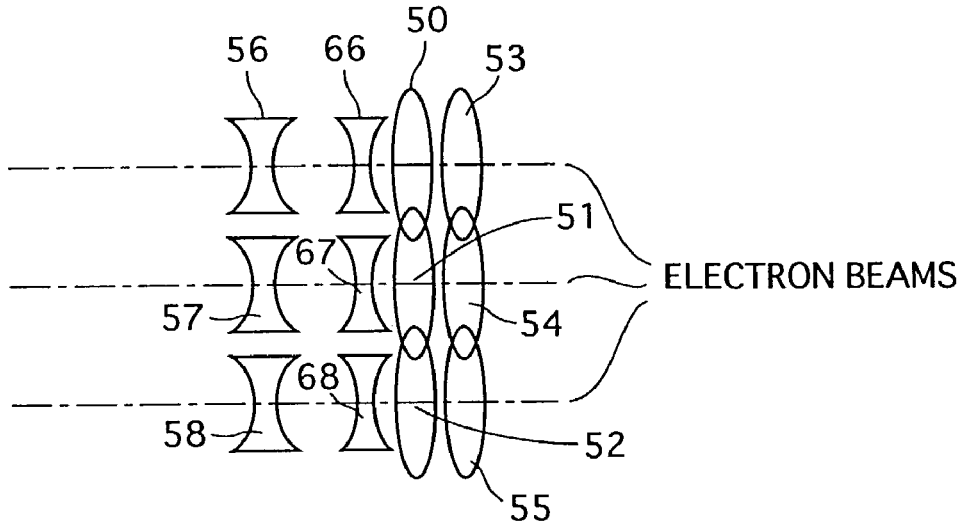
FIGS. 11A & 11B are model diagrams showing a main lens structure in the inline electron gun of embodiment 2.
Figure 11B:
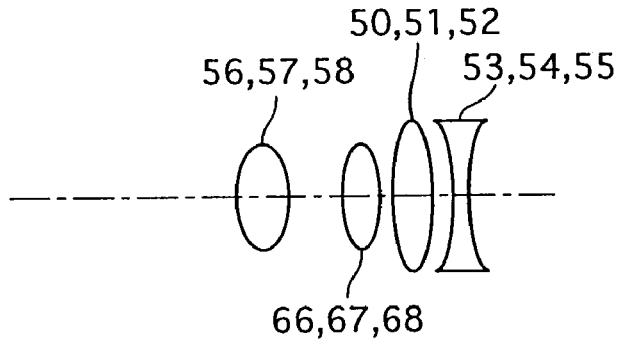

FIG. 10 is a plan view showing a structure of an inline electron gun according to the present embodiment, and FIGS. 11A and 11B show a related lens model.

A difference with embodiment 1 is that a pair of eave-shaped electrode plates 60 and 61 facing into and protruding toward the gap between focusing electrode 27 and final accelerating electrode 28 is also provided on field-correction electrode plate 27B.

According to this structure, as shown in FIGS. 11A and 11B, in addition to the lenses in FIG. 5, quadrupole lenses 66, 67 and 68 are generated that have, on the low-voltage side, greater divergent action horizontally (concave lens) and greater focusing action vertically (convex lens) than the main lenses.

Since these lenses allow for the horizontal focusing action to be weakened in the low-voltage area, which is an area greatly affected by spherical aberrations in the main lenses, it is possible to reduce horizontal spherical aberration, which affects the spot attributes to most.

Furthermore, the strength of quadrupole lenses 56, 57 and 58 on the cathode side is determined by the potential difference between electrodes 27 and 28, and since there is a limit to the size of this potential difference because of discharges and other problems that arise when attempting to strengthen the lens action, there is naturally a limitation on the strength of quadrupole lenses 56, 57 and 58 on the cathode-side. However, since lenses 66, 67 and 68 on the low-voltage side of the main lenses act to strengthen quadrupole lenses 56, 57 and 58 on the cathode-side, the HV differential can be increased without the above limitation applying, thereby raising the double quadrupole effect.

Embodiment 3

An embodiment 3 of the present invention will now be described.

Figure 12:
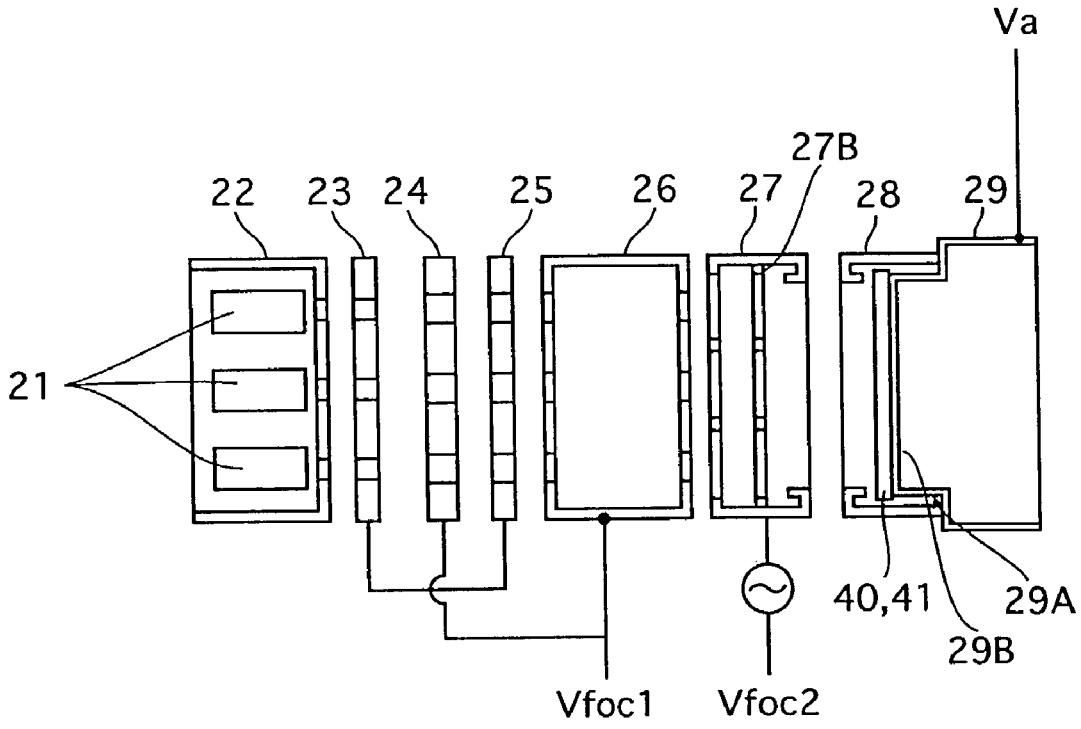
FIG. 12 is a plan view showing a structure of an inline electron gun according to an embodiment 3.
Figure 13:
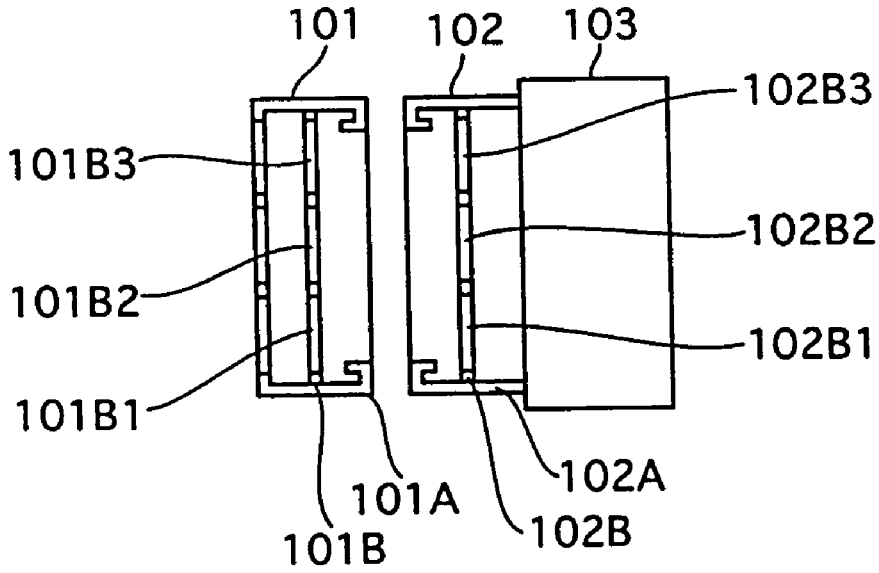
FIG.13 PRIOR ART
FIG. 13 is a plan view showing a structure of an inline electron gun (OLF lens structure) according to the prior art.

FIG. 12 is a plan view showing a structure of an inline electron gun according to embodiment 3.

In the inline electron gun of the present embodiment, as shown in this diagram, protrusions 29A are formed on the shield cap of the inline electron gun of embodiment 1, so as to protrude into the final accelerating electrode, and a base 29B of protrusions 29A functions as a field-correction electrode plate. Eave-shaped electrode plates 40 and 41, as described above, are provided on base 29B.

In addition to above actions/effects, it is possible according to this structure to dispose the field-correction electrode plate within the final accelerating electrode when the shield cap is fitted to the final accelerating electrode, and thus facilitate the assembly of the electron gun.

Here, although embodiments 2 and 3 can be implemented independently, they may also be combined. Joint effects can thus be obtained.

Furthermore, although the present invention is, as described above, particularly effective in technology for applying a dynamic voltage, it may also be applied as a HV differential adjustment means, even in an electron gun that does not apply a dynamic voltage to the electrodes.

According to the color picture tube apparatus of the present invention as described above, a method that avoids the design difficulties associated with providing eave-shaped electrode plates is used to form auxiliary lenses in addition to conventional main lenses, by adding eave-shaped electrode plates, and thus the horizontal and vertical focusing action differential of the main lenses can be increased, and further reductions in the dynamic voltage achieved as a result.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A color picture tube apparatus comprising:

a panel that includes a screen having phosphors of a plurality of colors disposed thereon;

an electron gun having a plurality of cathodes disposed inline and a focusing electrode and a final accelerating electrode forming a main lens electric field and a shield cap, the focusing electrode and the final accelerating electrode each including a tubular electrode having an aperture common to the electron beams and a field-correction electrode plate having a plurality of beam through holes wherein:

the tubular electrodes of the focusing electrode and the final accelerating electrode are disposed with a gap therebetween;

the field-correction electrode plate of the focusing electrode is set back from an edge of the aperture with a main surface facing the gap and is disposed at a position immediately adjacent to the aperture;

the field-correction electrode plate of the final accelerating electrode is set back from an edge of the aperture with a main surface facing the gap and is proved apart from a base of the shield cap; and a pair of eave-shaped electrode plates are provided on the field-correction electrode plate of at least one of the focusing electrode and the final accelerating electrode, so as to be on either side of the beam through holes in a vertical scan direction, and to extend horizontally and toward the gap.

2. The color picture tube apparatus of claim 1, wherein the pair of eave-shaped electrode plates are proved on the field-correction electrode plate of both the focusing electrode and the final accelerating electrode.

3. The color picture tube apparatus of claim 1, wherein the base of the shield cap protrudes into the final electrode and functions as the field-correction electrode plate.

* * * * *